United States Patent [19]

Sabin et al.

[11] Patent Number: 4,608,832

[45] Date of Patent: Sep. 2, 1986

[54] MEANS AND TECHNIQUES USEFUL IN DETECTING FROST

[75] Inventors: Cullen M. Sabin, Solana Beach; Heinz F. Poppendiek, La Jolla, both of Calif.

[73] Assignee: Geoscience, Ltd., Solana Beach, Calif.

[21] Appl. No.: 714,191

[22] Filed: Mar. 20, 1985

Related U.S. Application Data

[63] Continuation-in-part of Ser. No. 565,413, Dec. 27, 1983, abandoned, which is a continuation of Ser. No. 350,224, Feb. 19, 1982, abandoned.

[51] Int. Cl.[4] ..... F25D 21/02

[52] U.S. Cl. ..... 62/140; 62/156

[58] Field of Search ..... 62/140, 156, 128; 374/134; 340/581

[56] References Cited

U.S. PATENT DOCUMENTS

| | | | |
|---|---|---|---|
| 3,861,167 | 1/1975 | Nijo | 62/156 |
| 4,215,554 | 8/1980 | Pohl | 62/156 |
| 4,291,542 | 9/1981 | Sminge | 62/156 |

FOREIGN PATENT DOCUMENTS

| | | | |
|---|---|---|---|
| 0024344 | 2/1979 | Japan | 62/156 |

*Primary Examiner*—Harry Tanner

*Attorney, Agent, or Firm*—Frank E. Mauritz

[57] ABSTRACT

In a heat pump system wherein an evaporator is located outdoors with a stream of air being blown through spaced fins of the evaporator and frost is formed on the fins thereby impairing the efficiency of the heat exchanger, heat flow sensing means is positioned on one or more of such fins and in heat conducting relation to such fins for the purpose of controlling defrost means such that when frost is formed the heat flow sensing means causes defrosting.

6 Claims, 6 Drawing Figures

MEANS AND TECHNIQUES USEFUL IN DETECTING FROST

The present application is a continuation-in-part of our pending patent application Ser. No. 565,413 filed Dec. 27, 1983 which is a continuation of our patent application Ser. No. 350,224 filed on Feb. 19, 1982 both now abandoned.

The present invention relates to improved means and techniques useful in automatic defrosting of heat exchangers.

An object of the present invention is to provide improvements in the art of defrosting heat exchangers.

Another object of the present invention is to provide new teachings as to the means used and their placement with respect to location on heat exchangers for effecting their automatic defrosting.

Figure 1:
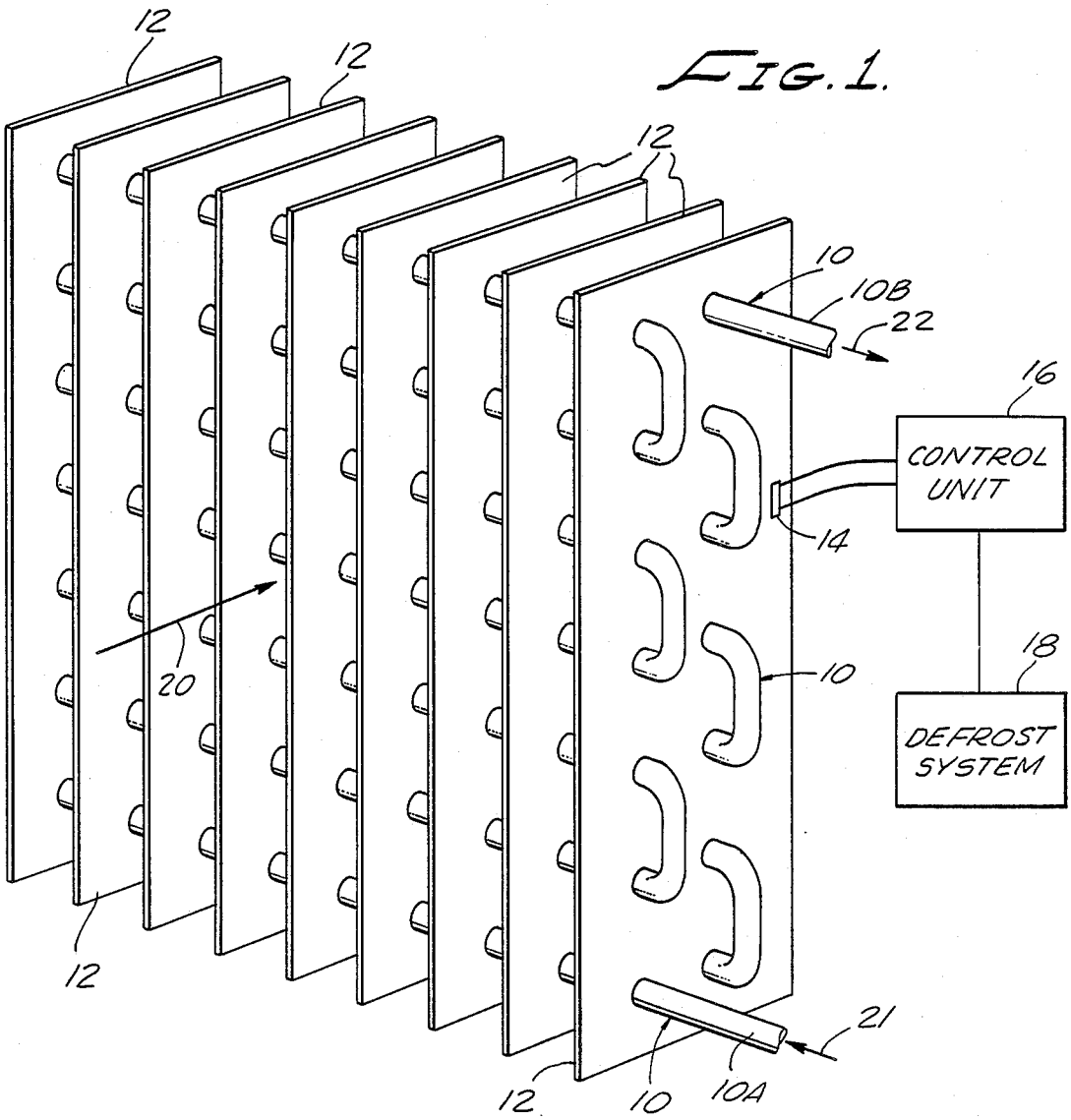
Figure 2:
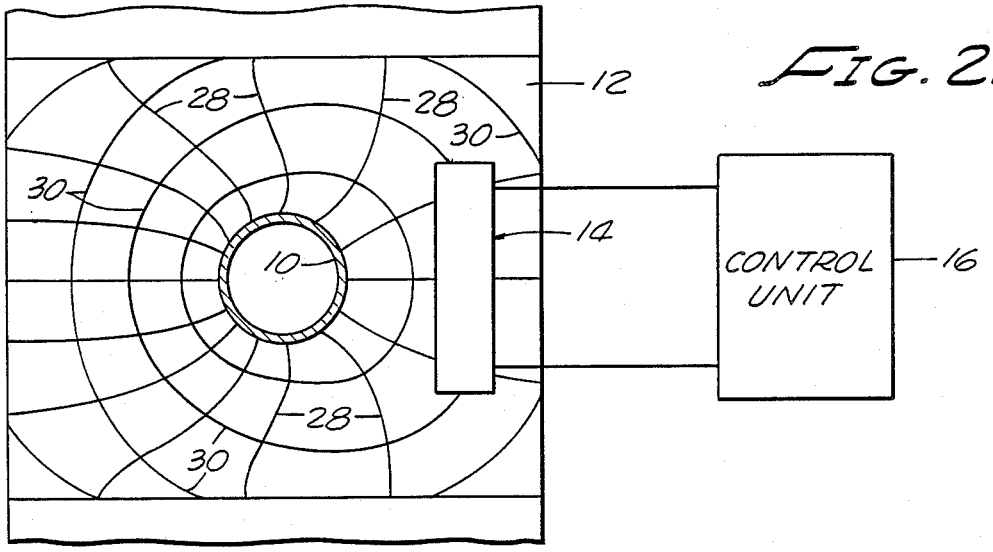
Figure 3:
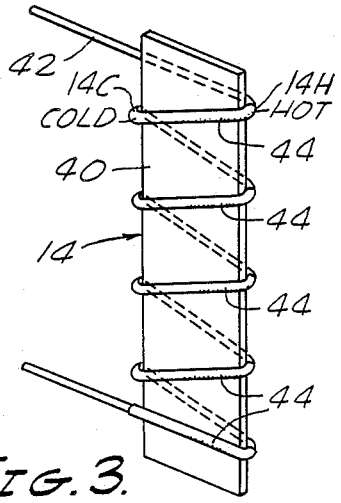

In the accompanying drawings:

FIG. 1 is a perspective view of a heat pump evaporator in relation to sensing and control means in accordance with features of the present invention, FIG. 2 illustrates a sectional view of one of the conduits in FIG. 1 in relation to the same sensing means and control unit or means and further illustrates a series of heat flow lines that are generally radial with associated generally circular lines of equal temperature, FIG. 3 is a perspective view illustrating constructional features of the sensing means shown in FIGS. 1 and 2, FIGS. 4, 5 and 6 illustrate operation and functioning of the sensing means shown in FIG. 1 with respect to temperature-distance relationships under the various conditions indicated in these various figures.

The invention has utility in a heat pump heating system that includes a compressor, an evaporator and a condenser with freon 12 being circulated through the evaporator and condenser. Such heating systems are conventional. The compressor and condenser (each not shown) are located in a space, as for example a room which is to be heated by the heat produced in the condenser and the evaporator is located outside the room in, for example the outside ambient air with the ambient air being blown over the evaporator by a fan (not shown) so as to extract heat from the ambient air and to transfer that heat to the freon 12 material, which flows from the evaporator via a conventional expansion valve (not shown) to the inside condenser which heats the indoor space in which it is located. The present invention is concerned with efficient operation of the evaporator in such a system under conditions wherein frost is likely to form on the evaporator and impair the flow of heat from the air to the evaporator.

Frost removal is essential. One method for removal of frost involves occassionally reversing the direction of heat flow in the heat pump so that heat is removed from the room or building and rejected to the outside air, thereby melting the frost on the outdoors evaporator in the process. In general, at least two reverse methods of control are presently in use. One, a demand system, initiates the defrost cycle when a substantial change in system heat load occurs. A second control method causes operation of the defrost system on a fixed time schedule that depends on likely frost temperatures.

Difficulties of prior art systems are that the frost build-up may be well advanced before the defrosting is accomplished, or that a defrost cycle may be actuated unnecessarily.

In accordance with the present invention frost layer is sensed by the change it produces in the evaporator heat transfer capability and the output of the sensing means in the form of a thermopile is used to effect the defrost operation before the frost layer persists in size for a long time or grows in size.

Heat exchangers used in air conditioning and heat pump systems are usually finned tube arrays such as illustrated in FIG. 1 wherein a single continuous tube 10 having a lower inlet portion 10A and an upper outlet portion 10B extends through and in heat conducting relationship to a series of parallel spaced fins 12. A heat sensor in the form of a thermopile 14 is mounted on and in heat conducting relationship to one or more of such fins and in optimum position as explained hereinafter. The output of the thermopile 14, which may be one or more in number is connected to a control unit illustrated at 16 which effects operation of a conventional defrost system in response to a change in electrical output of the thermopile 14. The defrost system 18 when operated by the control unit 16 defrosts the fin 12 upon which the thermopile is mounted to thereby restore the output of the thermopile to its normal defrost value.

Figure 4:
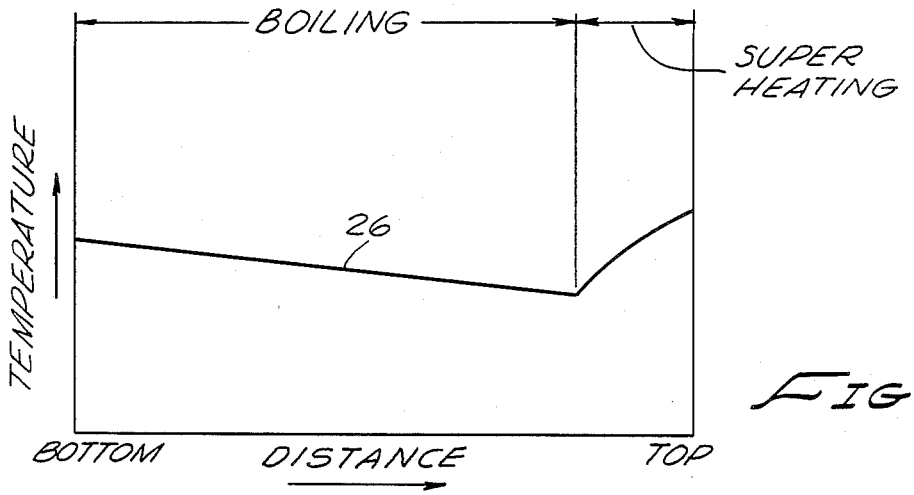

Heat from the air which is blown by a fan (not shown) in the direction of the arrow 20 is transfered into the fins 12 and then into the wall of tube 10 where it is then transfered to the evaporating refrigerant freon 12. The warmest part of each fin is at the front face of the exchanger where the air stream enters the assembly, and the coolest part of each fin is at the back edge of the fin usually in the upper half region wherein the thermopile is located in FIG. 1. Usually the refrigerant flows from the bottom to top as indicated by the arrows 21, 22 in FIG. 1 and in such case the lowest evaporation temperature is towards the top since there is a pressure drop in the direction of refrigerant flow. Due to the tendency of designers to provide excess capacity, there may be some vapor superheating in the extreme upper part of the exchanger with lower heat transfer rates in which case a maximum in frost accunulation may not be found to exist in the uppermost region, but in that region where the last wetted wall evaporation occurs. These conditions are illustrated in FIG. 4 wherein distance is measured from the bottom to the top of the exchanger and there is a change from a boiling refrigerant condition to a superheating condition near the top with corresponding change in temperature as indicated by the curve 26.

FIG. 2 indicates the general form of the lines of heat flow which extend generally radially from the tube 10 on the fin 12, and also illustrated in FIG. 2 are the isotherms which are generally circular and are representative of a series of equal temperature portions of the fin 12. The distance between the isotherms is representative of the difference in temperature i.e. temperature gradient. Frost formation usually occurs initially on the exposed portion of the tubing 10 between adjacent fins 12. Subsequent frost formation usually occurs on that portion of the fin which is downstream (referenced with respect to air flow) of the tube 10 where the fin is coolest. The thermopoile is placed as shown in FIG. 1 with those thoughts in mind.

Since in typical heat exchangers the fin area is much greater than the exposed tube area, the frost on the fin produces a greater resistance to heat transfer than does the frost on the tubes. Accordingly the heat sensor or transducer is designed to sense heat flow in the fins where first frost formation is expected. The heat flow in the fin is proportional to the local temperature gradient in the metal, which changes when an insulating layer of frost forms as illustrated in FIG. 5.

Figure 5:
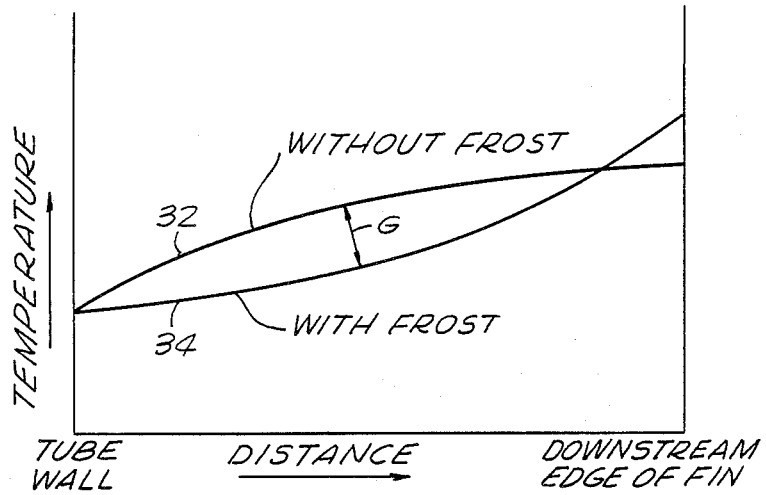
Figure 6:
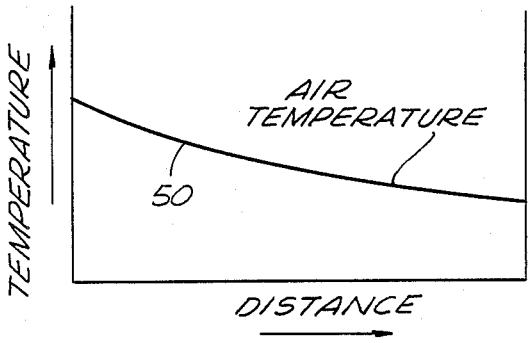

In FIG. 5 distance is measured from the tube wall to the downstream edge of the fin and the corresponding temperature without and with frost is represented by the corresponding curves. The change in temperature between these two conditions is illustrated as represented by G which is relatively large in value because there is a change in direction of the concavity of the curves 32,34. It is this change in temperature represented by G which produces a correspondingly large change in heat flow and correspondingly a large change in electrical output of the thermopile 14 which is located where such large temperature change occured.

The thermopile 14 may, for example, be constructed as described in U.S. Pat. No. 3,525,648 issued on Aug. 25, 1970 to Heinz F. Poppendiek, one of the applicants herein.

The thermocouple 14 as seen in FIG. 3 has a series of hot junctions 14H and a series of cold junctions 14C on opposite edges of the thermopile card 40 which maintains these series of junctions in spatial relationship. The thermopile 14 is used to sense heat flow or, as is sometimes called, heat flux, as distinct from sensing only a single isolated temperature. There is a difference between measuring or sensing heat flow (heat flux) and measuring or sensing merely a single temperature. Temperature may exist in the absence of heat flow or heat flux but, on the other hand, heat flow is the result of a temperature gradient, i.e., the difference in temperature of two different spaced regions between which the heat flows. This is explained perhaps more fully in the March 1969 publication in Environmental Quaterly of Heinz F. Poppendiek, one of the applicants herein.

This thermopile 14 as seen in FIG. 3 is affixed to the metal cooling fin 12 so that the series of cold junctions 14C sense and respond to the temperature at a portion of the fin 12 and the series of hot junctions 14H which are spaced from the cold junctions sense and respond to the temperature at another portion of the fin 12. The temperature difference between these two different portions of the fin at which the hot and cold junctions are located is dependent upon whether or not frost is present as illustrated in FIG. 5. In FIG. 5 the slope of temperature versus distance curve 34 (applicable when there is frost present) is different than the corresponding slope of curve 32 (when there is no frost present). This is so because of the difference in concavity i.e., curve 34 is concave upwardly whereas curve 32 is concave downwardly. The change in the condition between that represented in curve 32 to that represented in curve 34 produces a change in temperature gradient which causes a coresponding change in that heat flow or flux which is sensed by the thermopile 14.

In FIG. 2 the thermopile 14 is mounted on a part of the fin in an intermediate position between the outer edge of the fin 12 and tubing 10. The amount of heat flow or heat flux which is sensed by thermopile 14 is that which is caused to flow by the temperature gradient, ie., the difference in temperature between, on the one hand, the temperature of the location of the series of hot junctions 14H and, on the other hand, the temperature of the location of the series of cold junction 14C.

We claim:

1. In a heat exchange system wherein moisture in ambient cooling air produces frost on a heat exchanger through which refrigerent flows and impairs the transfer of heat from said exchanger, heat flow sensing means including a pair of temperature sensing means, each of said temperature sensing means being mounted externally of said heat exchanger in spatial relationship to each other and in heat conductive relationship to said exchanger to sensing the flow of heat from said exchanger and the impairment of said transfer and producing an output in accordance with said impairment, and means coupled to said sensing means and using said output for defrosting said exchanger.

2. A system as set forth in claim 1 in which said sensing means is a thermopile which senses the amount of heat flow, said thermopile having a series of hot junctions and a series of cold junctions, said series of hot junctions being spaced from said series of cold junctions, and said series of hot junctions serving as one of a pair of temperature sensing means and said series of cold junctions serving as the other one of said pair of temperature sensing means.

3. A system as set forth in claim 1 in which said heat exchanger includes said refrigerant flowing through refrigerant tubing in heat conductive relationship to a plurality of spaced cooling fins and said tubing and an air stream is directed from the front edge of said fins and past said refrigerant tubing between said fins and then towards the rear edges of said fins, said heat flow sensing means being mounted on at least one of said fins in a position downstream of air flow past said tubing.

4. A system as set forth in claim 3 in which said exchanger has a lower refrigerant inlet and an upper refrigerant outlet in communication with said tubes, and said sensing means is positioned in a region that is in the upper half portion of a fin.

5. In a system as set forth in claim 1 wherein the sensing means is located on said exchanger adjacent to a region inside the heat exchanger where the refrigerant goes from a boiling condition to a superheated condition under conditions where there is no change in ambient air conditions and also in heating requests in the system.

6. A system as set forth in claim 1 wherein said exchanger is in a heat pump system.

* * * * *